US009863337B2

(12) United States Patent
Ramappan et al.

(10) Patent No.: US 9,863,337 B2
(45) Date of Patent: Jan. 9, 2018

(54) SYSTEMS FOR REGENERATION OF A GASOLINE PARTICULATE FILTER

(71) Applicant: GM Global Technology Operations LLC, Detroit, MI (US)

(72) Inventors: Vijay Ramappan, Novi, MI (US); Jan Fritzsche, Herbersdorf (DE); Martino Casetti, Clarkston, MI (US); Jeremy J. Anderson, Royal Oak, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 274 days.

(21) Appl. No.: 14/575,231

(22) Filed: Dec. 18, 2014

(65) Prior Publication Data

US 2016/0123200 A1 May 5, 2016

Related U.S. Application Data

(60) Provisional application No. 62/073,546, filed on Oct. 31, 2014.

(51) Int. Cl.

| | |
|---|---|
| ***F01N 3/00*** | (2006.01) |
| ***F01N 3/02*** | (2006.01) |
| ***F02D 37/02*** | (2006.01) |
| ***F02D 41/02*** | (2006.01) |
| *F02D 41/00* | (2006.01) |

(52) U.S. Cl.

CPC ..... *F02D 37/02* (2013.01); *F02D 41/029* (2013.01); *F02D 41/0002* (2013.01); *F02D 2200/0802* (2013.01); *F02D 2200/0812* (2013.01); *F02D 2200/703* (2013.01); *F02D 2250/22* (2013.01)

(58) Field of Classification Search

CPC ..... F02D 2200/0802; F02D 2200/0812; F02D 2200/703; F02D 2250/22; F02D 41/0002; F02D 41/029; F02D 37/02

USPC ..... 60/285, 295, 297, 311

See application file for complete search history.

(56) References Cited

U.S. PATENT DOCUMENTS 6,412,276 B1 * 7/2002 Salvat ..... F02D 41/029 60/280
9,051,889 B2 * 6/2015 Swoish ..... F02D 41/029
(Continued)

FOREIGN PATENT DOCUMENTS

CN 101660457 A 3/2010

*Primary Examiner* — Phutthiwat Wongwian
*Assistant Examiner* — Diem Tran

(57) ABSTRACT

A system includes a soot module, a coordinator module, a regeneration module, and actuator modules. The soot module determines a current amount of soot mass in a particulate filter of a gasoline engine, where the particulate filter is downstream from the gasoline engine and receives an exhaust gas from the gasoline engine. The coordinator module generates an enable signal, a torque reserve signal, and an equivalence ratio. The regeneration module, based on the current amount of soot mass and the enable signal, generates a regeneration signal to regenerate the particulate filter. The actuator modules, based on the regeneration signal, the torque reserve signal and the equivalence ratio, retard spark and increase an amount of air flow to the particulate filter. The actuators maintain a same amount of torque out of the gasoline engine during regeneration as output from the gasoline engine prior to the regeneration of the particulate filter.

19 Claims, 7 Drawing Sheets

(56) References Cited

U.S. PATENT DOCUMENTS

| | | | | |
|---|---|---|---|---|
| 2006/0218903 | A1* | 10/2006 | Ogata | F01N 3/023 60/295 |
| 2010/0005785 | A1* | 1/2010 | Breuer | F02D 41/0255 60/286 |
| 2011/0072794 | A1* | 3/2011 | Van Nieuwstadt | F01N 3/101 60/285 |
| 2011/0088374 | A1* | 4/2011 | Johnson | F01N 3/023 60/285 |

* cited by examiner

SYSTEMS FOR REGENERATION OF A GASOLINE PARTICULATE FILTER

CROSS-REFERENCE TO RELATED APPLICATIONS

This application claims the benefit of U.S. Provisional Application No. 62/073,546, filed on Oct. 31, 2014. The entire disclosure of the application referenced above is incorporated herein by reference.

FIELD

The present disclosure relates to regeneration of particulate filters of petrol (also referred to as gasoline) internal combustion engines.

BACKGROUND

The background description provided here is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

A gasoline internal combustion engine (ICE) typically includes an exhaust system with a catalytic converter. The exhaust system may also include a gasoline particulate filter (GPF) downstream from the catalytic converter. The GPF filters soot and particulates from an exhaust gas output from the gasoline ICE.

During operation of a gasoline ICE, a level of oxygen ($O_2$) in a GPF of the gasoline ICE can be below a level needed to oxidize soot in the GPF. In addition, a temperature of an exhaust gas received by the GPF can be in a temperature range (e.g., at a temperature less than a predetermined temperature) that is not conducive for soot oxidation. Thus, regeneration of the GPF may not be performed and/or may not be efficiently performed during certain operating conditions. Inefficient regeneration can also occur during fuel cut off events when there is an abundance of oxygen ($O_2$) in the GPF but the GPF is no at a sufficient temperature for oxidation. Examples of fuel cut off events are clutch fuel cut off (CFCO) events and deceleration fuel cut off (DFCO) events. Fuel cut off events can occur as a result of cylinder deactivation. A cylinder deactivation system may deactivate one or more cylinders of an engine during operation of the engine to conserve fuel.

DFCO is used for various reasons. DFCO may be used to provide deceleration (powertrain braking) force when an accelerator of a vehicle is not actuated (e.g., vehicle operator does not press on accelerator pedal). In high elevation (mountainous) areas and/or areas with large variations in elevation, DFCO is used to provide powertrain braking to avoid damage to friction brakes of a vehicle.

DFCO may also be used to prevent damage to a catalytic converter. For example, a throttle position may be calibrated and fixed to provide a minimal amount of air-per-cylinder (APC) to an engine, thereby providing vehicle deceleration when traveling downhill. Due to the fixed throttle position and/or a manual pull down of a transmission (PRNDL) shifter (e.g., shift into a low gear, such as L1 or L2), the APC levels of the ICE can become too low and cause a misfire. A misfire refers to incomplete combustion of an air/fuel mixture in a cylinder of the engine. This misfire can result in fuel entering and igniting in an exhaust system, which increases temperature of a catalyst of the catalytic converter. Damage to the catalyst can occur when temperatures of the catalyst exceed a threshold. By using DFCO, fuel is disabled, which protects the catalyst from misfire events.

DFCO may also be used to increase fuel economy. The efficiency of a gasoline spark ignited engine can be low at minimum combustion (i.e. minimum air and fuel levels) because of pumping losses and other factors. Disabling the fuel is more efficient than reducing the amount of fuel to an ICE.

SUMMARY

A system is provided and includes a soot module, a coordinator module, a regeneration module, and actuator modules. The soot module is configured to determine a current amount of soot mass in a particulate filter of a gasoline engine, where the particulate filter is downstream from the gasoline engine and receives an exhaust gas from the gasoline engine. The coordinator module is configured to generate an enable signal, a torque reserve signal, and an equivalence ratio. The regeneration module is configured to, based on the current amount of soot mass and the enable signal, generate a regeneration signal to regenerate the particulate filter. The actuator modules are configured to, based on the regeneration signal, the torque reserve signal and the equivalence ratio, (i) retard spark of the gasoline engine, and (ii) increase an amount of air flow to the particulate filter, where the actuator modules are configured to maintain a same amount of torque out of the gasoline engine during regeneration of the particulate filter as output from the gasoline engine prior to the regeneration of the particulate filter. The actuator modules may also (i) change the equivalence ratio to increase exhausted $O_2$, (ii) enable multiple fuel injections per combustion cycle, (iii) increase a stationary idle speed and (iv) change an amount of trapped combustion residuals by altering intake and/or exhaust valve timings.

In other features, a system is provided and includes a soot module, an enabling module, a coordinator module, a regeneration module, and actuator modules. The soot module is configured to determine a current amount of soot mass in a particulate filter of a gasoline engine, where the particulate filter is downstream from the gasoline engine and receives an exhaust gas from the gasoline engine. The enabling module is configured to compare a temperature of the exhaust gas entering the particulate filter to a predetermined threshold and generate an enable signal based on the comparison. The coordinator module is configured to, based on the comparison, generate an equivalence ratio that is lean of stoichiometry. The regeneration module is configured to, based on the current amount of soot mass, generate a regeneration signal to regenerate the particulate filter. The actuator modules are configured to operate the engine at a stoichiometric air/fuel ratio based on whether the equivalence ratio is generated, and based on the regeneration signal and the equivalence ratio, increase an amount of air flow to the particulate filter. Operation at the stoichiometric air/fuel ratio and/or a lean stoichiometric air/fuel ratio may be based on whether the equivalence ratio is generated and/or whether a torque reserve is requested by the coordinator module. The torque reserve may be requested to increase temperature of the gasoline particulate filter.

In other features, a system is provided and includes a soot module, an enabling module, a coordinator module, a regeneration module and actuator modules. The soot module is configured to determine a current amount of soot mass in a particulate filter of a gasoline engine, where the particulate filter is downstream from the gasoline engine and receives an exhaust gas from the gasoline engine. The enabling module is configured to compare a temperature of the exhaust gas entering the particulate filter to a predetermined threshold and generate an enable signal based on the comparison. The coordinator module is configured to, based on the comparison, generate a torque reserve signal based on a temperature of the particulate filter. The regeneration module is configured to, based on the current amount of soot mass, generate regeneration signal to regenerate the particulate filter. The actuator modules are configured to retard spark of the gasoline engine based on (i) the regeneration signal, and (ii) the torque reserve signal. The actuator modules may also be configured to provide a lean of stoichiometry equivalence ratio thereby decreasing an amount of fuel supplied to the gasoline engine and increasing the amount of oxygen at the gasoline particulate filter.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

In the drawings, reference numbers may be reused to identify similar and/or identical elements.

DETAILED DESCRIPTION

Examples are provided below for regenerating a particulate filter of a gasoline engine. The examples include increasing and maintaining a temperature of the particulate filter above a predetermined threshold and increasing air flow to the particulate filter to facilitate and efficiently regenerate the particulate filter. The examples further include enabling and disabling torque reserve requests based on temperatures of the particulate filter to facilitate regeneration of the particulate filter and minimize regeneration time.

Figure 1:
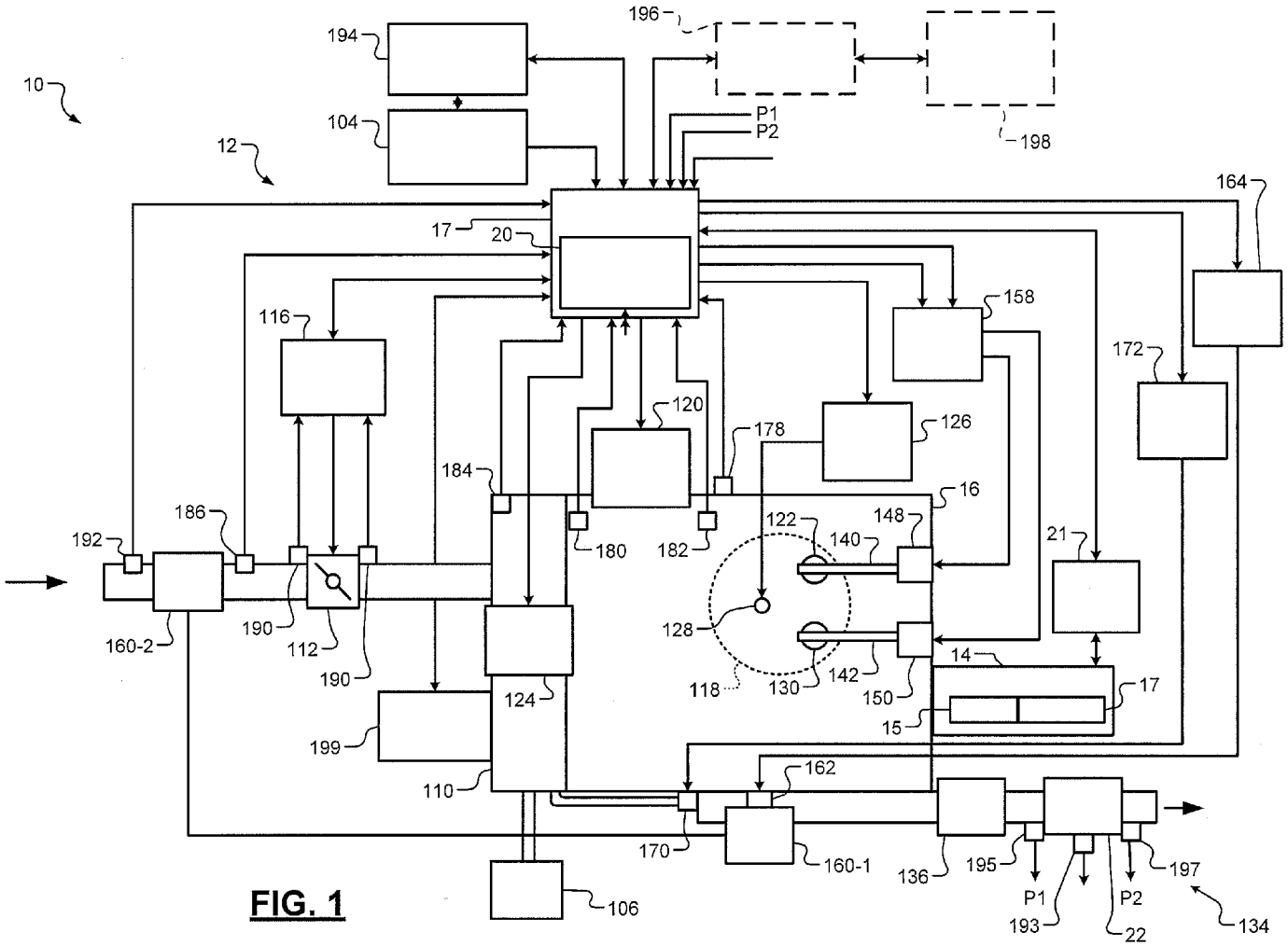
FIG. 1 is a functional block diagram of a powertrain system incorporating a GPF module in accordance with the present disclosure.

FIG. 1 shows a powertrain system 10 that includes an engine system 12 and a transmission system 14, which may include a torque converter clutch 15. The engine system 12 includes an engine 16 and an engine control module (ECM) 17 with a GPF module 20. The transmission system 14 includes a transmission control module (TCM) 21. The transmission system 14 may include, for example, an automatic transmission, a semi-automatic transmission, a dual clutch transmission, etc. (hereinafter transmission 17). The GPF module 20 controls regeneration of a GPF 22 in an exhaust system 24 of the engine 16. Operation of the GPF module 20 is further described below with respect to FIGS. 2-7.

The powertrain system 10 includes the engine 16 that combusts an air/fuel mixture to produce drive torque for a vehicle based on driver input from a driver input module 104. Air is drawn into an intake manifold 110 through a throttle valve 112. The ECM 17 controls a throttle actuator module 116, which regulates opening of the throttle valve 112 to control the amount of air drawn into the intake manifold 110. A brake booster 106 draws vacuum from the intake manifold 110 when the pressure within the intake manifold 110 is less (i.e., is a greater vacuum) than a pressure within the brake booster 106. The brake booster 106 assists a vehicle user in applying brakes of the vehicle.

Air from the intake manifold 110 is drawn into cylinders (one is shown) of the engine 16. The ECM 17 may instruct a cylinder actuator module 120 to selectively deactivate some of the cylinders, which may improve fuel economy under certain engine operating conditions. The engine 16 may operate using a four-stroke cylinder cycle. The four strokes, described below, are named the intake stroke, the compression stroke, the combustion stroke, and the exhaust stroke. During each revolution of a crankshaft (not shown), two of the four strokes occur within the cylinder 118.

During the intake stroke, air from the intake manifold 110 is drawn into the cylinder 118 through an intake valve 122. The ECM 17 controls a fuel actuator module 124, which regulates fuel injection to achieve a desired air/fuel ratio. Fuel may be injected into the intake manifold 110 at a central location or at multiple locations, such as near the intake valve 122 of each of the cylinders. In various implementations (not shown), fuel may be injected directly into the cylinders or into mixing chambers associated with the cylinders. The fuel actuator module 124 may halt injection of fuel to cylinders that are deactivated.

The injected fuel mixes with air and creates an air/fuel mixture in the cylinder 118. During the compression stroke, a piston (not shown) within the cylinder 118 compresses the air/fuel mixture. Based on a signal from the ECM 17, a spark actuator module 126 energizes a spark plug 128 in the cylinder 118, which ignites the air/fuel mixture. The timing of the spark may be specified relative to the time when the piston is at its topmost position, referred to as top dead center (TDC).

The spark actuator module 126 may be controlled by a timing signal specifying how far before or after TDC to generate the spark. Because piston position is directly related to crankshaft rotation, operation of the spark actuator module 126 may be synchronized with crankshaft angle. In various implementations, the spark actuator module 126 may halt provision of spark to deactivated cylinders.

During the combustion stroke, the combustion of the air/fuel mixture drives the piston down, thereby driving the crankshaft. During the exhaust stroke, the piston begins moving up from bottom dead center (BDC) and expels the byproducts of combustion through an exhaust valve 130. The byproducts of combustion are exhausted from the vehicle via an exhaust system 24.

The exhaust system 24 includes a catalyst 136 and the GPF 22. A catalyst 136 receives exhaust gas output by the engine 16 and reacts with various components of the exhaust gas. For example only, the catalyst may include a three-way catalyst (TWC), a catalytic converter, or another suitable exhaust catalyst. The GPF 22 may be downstream from the catalyst 136 and filters soot from an exhaust gas received from the catalyst.

The intake valve 122 may be controlled by an intake camshaft 140, while the exhaust valve 130 may be controlled by an exhaust camshaft 142. The cylinder actuator module 120 may deactivate the cylinder 118 by disabling opening of the intake valve 122 and/or the exhaust valve 130. In various other implementations, the intake valve 122 and/or the exhaust valve 130 may be controlled by devices other than camshafts, such as electromagnetic actuators.

The times at which the intake and exhaust valves 122, 130 are opened may be varied with respect to piston TDC by intake and exhaust cam phasers 148, 150. A phaser actuator module 158 may control the intake and exhaust cam phasers 148, 150 based on signals from the ECM 17.

The powertrain system 10 may include a boost device that provides pressurized air to the intake manifold 110. For example, FIG. 1 shows a turbocharger including a hot turbine 160-1 that is powered by hot exhaust gases flowing through the exhaust system 24. The turbocharger also includes a cold air compressor 160-2, driven by the turbine 160-1, which compresses air leading into the throttle valve 112. In various implementations, a supercharger (not shown), driven by the crankshaft, may compress air from the throttle valve 112 and deliver the compressed air to the intake manifold 110.

A wastegate 162 may allow exhaust to bypass the turbine 160-1, thereby reducing the boost (the amount of intake air compression) of the turbocharger. The ECM 17 may control the turbocharger via a boost actuator module 164. The boost actuator module 164 may modulate the boost of the turbocharger by controlling the position of the wastegate 162.

The powertrain system 10 may include an exhaust gas recirculation (EGR) valve 170, which selectively redirects exhaust gas back to the intake manifold 110. The EGR valve 170 may be located upstream of the turbocharger's turbine 160-1. The EGR valve 170 may be controlled by an EGR actuator module 172.

The powertrain system 10 may measure the speed of the crankshaft (i.e., engine speed) in revolutions per minute (RPM) using an RPM sensor 178. Temperature of engine oil may be measured using an oil temperature (OT) sensor 180. Temperature of engine coolant may be measured using an engine coolant temperature (ECT) sensor 182. The ECT sensor 182 may be located within the engine 16 or at other locations where the coolant is circulated, such as a radiator (not shown). A temperature of the engine may be indicated as $T_{ENG}$. The temperature of the engine $T_{ENG}$ may be equal to or determined based on the engine oil temperature and/or the engine coolant temperature.

The pressure within the intake manifold 110 may be measured using a manifold absolute pressure (MAP) sensor 184. The mass flow rate of air flowing into the intake manifold 110 may be measured using a mass air flowrate (MAF) sensor 186. In various implementations, the MAF sensor 186 may be located in a housing that also includes the throttle valve 112.

The throttle actuator module 116 may monitor the position of the throttle valve 112 using one or more throttle position sensors (TPS) 190. The ambient temperature of air being drawn into the engine 16 may be measured using an intake air temperature (IAT) sensor 192. The ECM 17 may use signals from one or more of the sensors to make control decisions for the powertrain system 10.

The ECM 17 may communicate with the TCM 21 to coordinate shifting gears (and more specifically gear ratio) in a transmission (not shown). For example, the ECM 17 may reduce engine torque during a gear shift. The ECM 17 may communicate with a hybrid control module 196 to coordinate operation (i.e., torque output production) of the engine 16 and an electric motor 198.

The electric motor 198 may also function as a generator, and may be used to produce electrical energy for use by vehicle electrical systems and/or for storage in an energy storage device (e.g., a battery). The production of electrical energy may be referred to as regenerative braking. The electric motor 198 may apply a braking (i.e., negative) torque on the engine 16 to perform regenerative braking and produce electrical energy. The powertrain system 10 may also include one or more additional electric motors. In various implementations, various functions of the ECM 17, the TCM 21, and the hybrid control module 196 may be integrated into one or more modules.

Each system that varies an engine parameter may be referred to as an engine actuator. Each engine actuator receives an associated actuator value. For example, the throttle actuator module 116 may be referred to as an engine actuator and the throttle opening area may be referred to as the associated actuator value. In the example of FIG. 1, the throttle actuator module 116 achieves the throttle opening area by adjusting an angle of the blade of the throttle valve 112.

Similarly, the spark actuator module 126 may be referred to as an engine actuator, while the associated actuator value may be the amount of spark advance relative to cylinder TDC. Other actuators may include the cylinder actuator module 120, the fuel actuator module 124, the phaser actuator module 158, the boost actuator module 164, and the EGR actuator module 172. For these engine actuators, the associated actuator values may include: a number of activated cylinders; a fueling rate; intake and exhaust cam phaser angles; a boost pressure; and an EGR valve opening area. The ECM 17 may control actuator values in order to cause the engine 16 to generate a desired engine output torque.

The powertrain system 10 may further include one or more devices and/or accessories 199 that engage with and/or provide a load on the engine 16. The devices and/or accessories may include an air-conditioning system, compressor and/or clutch, an alternator, a generator, a cooling fan, etc. The ECM 17 may control operation of the device and/or accessories 199.

The engine system 12 may further include any number of temperature and/or pressure sensors on the exhaust system 12 for detecting temperatures and/or pressures of exhaust gas, temperatures of the catalyst 136, temperatures of the GPF 24, and/or pressures in and out of the catalyst 136 and/or the GPF 24. A temperature sensor 193 is shown for detecting a temperature $T_{GPF}$ of the GPF 24. Pressure sensors 195, 197 are shown for detecting inlet and outlet pressures P1 and P2 of the GPF 24.

Figure 2:
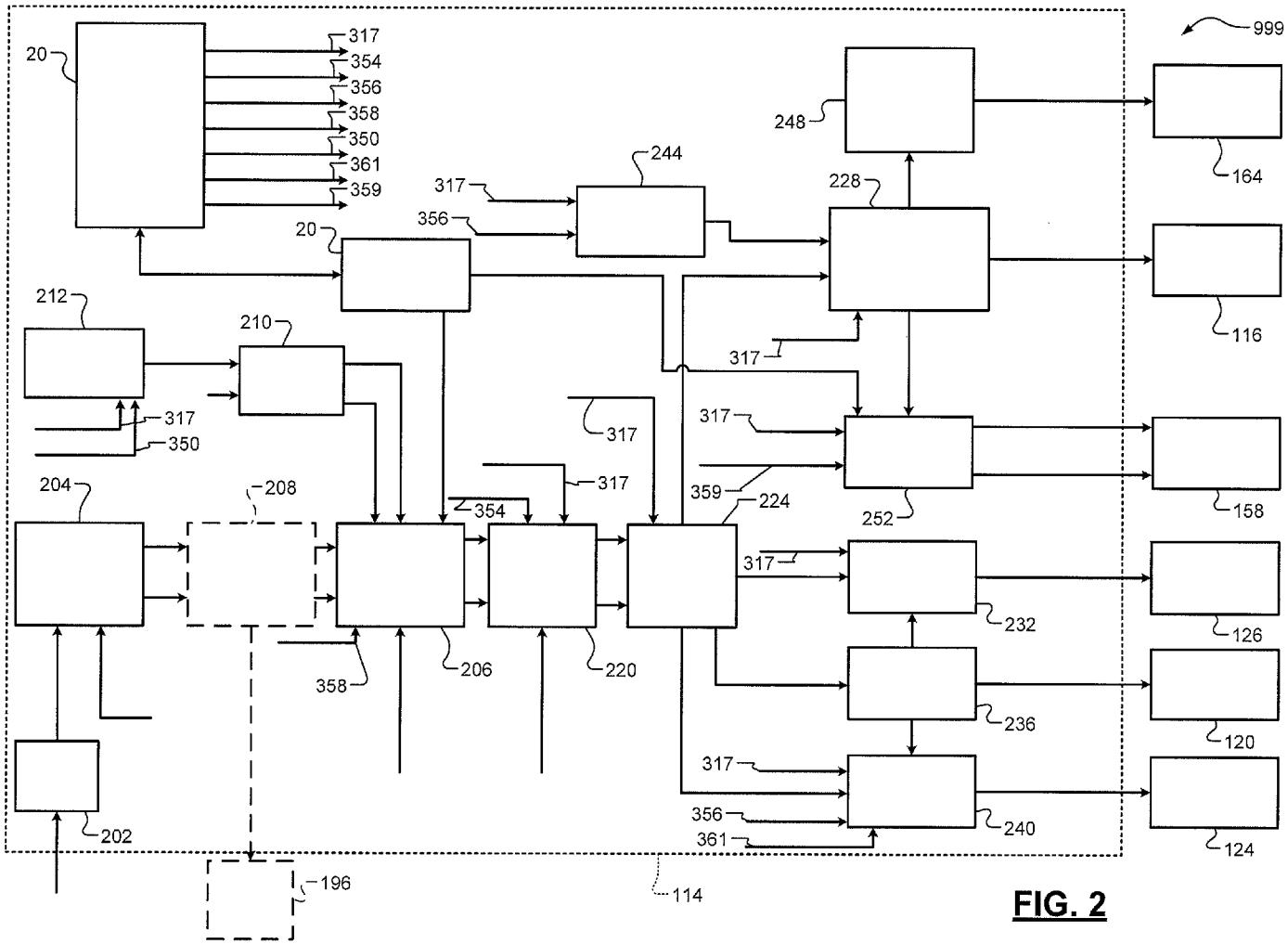
FIG. 2 is a functional block diagram of a control system incorporating an engine control module including the GPF module in accordance with the principles of the present disclosure.

FIG. 2 shows a control system 200 that includes the ECM 17 (or a portion thereof). The ECM 17 includes the GPF module 20, which is described in more detail below. See, for example, the section entitled GPF REGENERATION and the following description. The ECM 17 also includes a driver torque module 202 that determines a driver torque request based on driver input(s) from the driver input module 104. The driver input may be based on a position of an accelerator pedal and/or based on a cruise control input.

An axle torque arbitration module 204 arbitrates between the driver torque request from the driver torque module 202 and other axle torque requests. Torque requests may include absolute torque requests as well as relative torque requests and ramp requests. For example only, ramp requests may include a request to ramp torque down to a minimum engine off torque or to ramp torque up from the minimum engine off torque. Relative torque requests may include temporary or persistent torque reductions or increases. Each torque request may include data indicating the system or module that generated that torque request (i.e., the requestor).

Axle torque requests may include a torque reduction requested by a traction control system when positive wheel slip is detected. Positive wheel slip occurs when axle torque overcomes friction between the wheels and the road surface, and the wheels begin to slip against the road surface in a forward direction. Axle torque requests may also include a torque increase request to counteract negative wheel slip, where a tire of the vehicle slips in a reverse direction with respect to the road surface because the axle torque is negative.

Axle torque requests may also include brake management requests and vehicle over-speed torque requests. Brake management requests may reduce the engine output torque to ensure that the engine output torque does not exceed the ability of the brakes to hold the vehicle when the vehicle is stopped. Vehicle over-speed torque requests may reduce the engine output torque to prevent the vehicle from exceeding a predetermined speed. Axle torque requests may also be generated by vehicle stability control systems.

The axle torque arbitration module 204 outputs a predicted torque request and an immediate torque request based on the results of arbitrating between the received torque requests. As described below, the predicted and immediate torque requests from the axle torque arbitration module 204 may selectively be adjusted by other modules before being used to control actuators of the engine 16.

In general terms, the immediate torque request is the amount of currently desired engine output torque, while the predicted torque request is the amount of engine output torque that may be needed on short notice. The ECM 17 therefore controls the engine 16 to produce an engine output torque equal to the immediate torque request. However, different combinations of actuator values may result in the same engine output torque. The ECM 17 may therefore control the actuator values to allow a faster transition to the predicted torque request, while still maintaining the engine output torque at the immediate torque request.

In various implementations, the predicted torque request may be based on the driver torque request. The immediate torque request may be less than the predicted torque request, such as when the driver torque request is causing positive wheel slip on an icy surface. In such a case, a traction control system (not shown) may request a reduction via the immediate torque request, and the ECM 17 reduces the torque produced by the engine 16 to the immediate torque request. However, the ECM 17 controls the engine actuators so that the engine 16 can quickly resume producing the predicted torque request once positive wheel slip stops.

In general terms, the difference between the immediate torque request and the predicted torque request can be referred to as a torque reserve. The torque reserve represents the amount of torque more than the immediate torque request that the engine 16 can begin to produce with minimal delay. Fast engine actuators are used to increase or decrease the engine output torque. As described in more detail below, fast engine actuators are defined based on their ability to produce a response in the engine output torque relative to slow engine actuators.

In various implementations, fast engine actuators are capable of varying engine output torque within a range, where the range is established by the slow engine actuators. In such implementations, the upper limit of the range is the predicted torque request, while the lower limit of the range is limited by a torque capacity of the fast engine actuators.

In general terms, fast engine actuators can change the engine output torque more quickly than slow engine actuators can. Slow engine actuators may respond more slowly to changes in their respective actuator values than fast engine actuators do. For example, a slow engine actuator may include mechanical components that require time to move from one position to another in response to a change in the associated actuator value.

A slow engine actuator may also be characterized by the amount of time it takes for the engine output torque to begin to change once the slow engine actuator begins to implement the changed actuator value. Generally, this amount of time will be longer for slow engine actuators than for fast engine actuators. In addition, even after the engine output torque begins to change, the engine output torque may take longer to reach an engine output torque that is expected to result from the changed actuator value.

For example only, the ECM 17 may set actuator values for slow engine actuators to values that would enable the engine 16 to produce the predicted torque request if the fast engine actuators were set to appropriate values. Meanwhile, the ECM 17 may set actuator values for fast engine actuators to values that, given the slow actuator values, cause the engine 16 to produce the immediate torque request instead of the predicted torque request.

The fast actuator values therefore cause the engine 16 to produce the immediate torque request. When the ECM 17 decides to transition the engine output torque from the immediate torque request to the predicted torque request, the ECM 17 changes the actuator values associated with one or more fast engine actuators to values that correspond to the predicted torque request. Because the actuator values associated with the slow engine actuators have already been set based on the predicted torque request, the engine 16 is able to produce the predicted torque request after only the delay attributable to the fast engine actuators. In other words, the longer delay that would otherwise result from changing engine output torque using slow engine actuators is avoided.

For example only, when the predicted torque request is equal to the driver torque request, a torque reserve may be created when the immediate torque request is less than the drive torque request due to a temporary torque reduction request. Alternatively, a torque reserve may be created by increasing the predicted torque request above the driver torque request while maintaining the immediate torque request at the driver torque request.

The resulting torque reserve can be used to offset sudden increases in required engine output torque. For example only, sudden loads from an air conditioner or a power steering pump may be offset by increasing the immediate torque request. If the increase in immediate torque request is less than the torque reserve, the increase can be quickly produced by using fast engine actuators. The predicted torque request may then also be increased to re-establish the previous torque reserve.

As another example, a torque reserve may be used to reduce fluctuations in slow actuator values. Because of their relatively slow speed, varying slow actuator values may produce control instability. In addition, slow engine actuators may include mechanical parts, which may draw more power and/or wear more quickly when moved frequently.

Creating a sufficient torque reserve allows changes in desired torque to be made by varying fast engine actuators via the immediate torque request while maintaining the values of the slow engine actuators. For example only, to maintain a given idle speed, the immediate torque request may vary within a range. If the predicted torque request is set to a level above this range, variations in the immediate torque request that maintain the idle speed can be made using fast engine actuators without the need to adjust slow engine actuators.

After receiving a new actuator value, the spark actuator module 126 may be able to change spark timing for the following firing event. When the spark timing (also called spark advance) for a firing event is set to a calibrated value, a maximum torque is produced in the combustion stroke immediately following the firing event. However, a spark advance deviating from the calibrated value may reduce the amount of torque produced in the combustion stroke. Therefore, the spark actuator module 126 may be able to vary engine output torque as soon as the next firing event occurs by varying the spark timing. For example only, a table of spark timings corresponding to different engine operating conditions may be determined during a calibration phase of vehicle design, and the calibrated value is selected from the table based on current engine operating conditions.

By contrast, changes in throttle opening area take longer to affect the engine output torque. The throttle actuator module 116 changes the throttle opening area by adjusting the angle of the blade of the throttle valve 112. Therefore, once a new actuator value is received, there is a mechanical delay as the throttle valve 112 moves from its previous position to a new position based on the new actuator value. In addition, airflow changes based on the throttle valve opening are subject to air transport delays in the intake manifold 110. Further, increased airflow into the intake manifold 110 is not realized as an increase in engine output torque until the cylinder 118 receives additional air in the next intake stroke, compresses the additional air, and commences the combustion stroke.

Using the throttle opening area and the spark timing in an example, a torque reserve can be created by setting the throttle opening area to a value that would allow the engine 16 to produce a predicted torque request. Meanwhile, the spark timing can be set based on an immediate torque request that is less than the predicted torque request. Although the throttle opening area generates enough airflow for the engine 16 to produce the predicted torque request, the spark timing is retarded (which reduces the engine output torque) based on the immediate torque request. The engine output torque will therefore be equal to the immediate torque request.

When additional torque is needed, such as when the air-conditioning compressor is engaged, or when traction control determines that wheel slip has ended, the spark timing can be set based on the predicted torque request. By the following firing event, the spark actuator module 126 may return the spark timing to a calibrated value, which allows the engine 16 to produce the maximum engine output torque. The engine output torque may therefore be quickly increased to the predicted torque request without experiencing delays from changing the throttle opening area.

The axle torque arbitration module 204 may output the predicted torque request and the immediate torque request to a propulsion torque arbitration module 206. Depending on the type of hybrid vehicle, the axle torque arbitration module 204 may output the predicted and immediate torque requests to the hybrid control module 196.

The predicted and immediate torque requests received by the propulsion torque arbitration module 206 are converted from an axle torque domain (torque at the wheels) into a propulsion torque domain (torque at the crankshaft). In some implementations, the predicted and immediate torque requests may be converted into the propulsion torque domain before being provided to the propulsion torque arbitration module 206. In some implementations, the predicted and immediate torque requests in the propulsion torque domain may be provided to the hybrid control module 196. The hybrid control module 196 may control the electric motor 198 based on one or more of the torque requests and may provide modified predicted and immediate torque requests to the propulsion torque arbitration module 206.

The propulsion torque arbitration module 206 arbitrates between propulsion torque requests, including the converted predicted and immediate torque requests. The propulsion torque arbitration module 206 generates an arbitrated predicted torque request and an arbitrated immediate torque request based on the arbitration. The arbitrated torque requests may be generated by selecting a winning request from among received requests. Alternatively or additionally, the arbitrated torque requests may be generated by modifying one of the received requests based on another one or more of the received requests.

Other propulsion torque requests may include torque reductions for engine over-speed protection, torque increases for stall prevention, and torque reductions requested by the transmission control module 194 to accommodate gear shifts. The other propulsion torque requests may also include an engine shutoff request, which may be initiated when a critical fault is detected. For example only, critical faults may include detection of vehicle theft, a stuck starter motor, electronic throttle control problems, and unexpected torque increases. In various implementations, when an engine shutoff request is present, arbitration selects the engine shutoff request as the winning request. When the engine shutoff request is present, the propulsion torque arbitration module 206 may output zero as the arbitrated torques.

In various implementations, an engine shutoff request may simply shut down the engine 16 separately from the arbitration process. The propulsion torque arbitration module 206 may still receive the engine shutoff request so that, for example, appropriate data can be fed back to other torque requestors. For example, all other requestors may be informed that they have lost arbitration.

A reserves/loads module 220 receives the arbitrated predicted and immediate torque requests from the propulsion torque arbitration module 206. The reserves/loads module 220 may adjust the arbitrated predicted and immediate torque requests to create a torque reserve and/or to compensate for one or more loads. The reserves/loads module 220 then outputs the adjusted predicted and immediate torque requests to an actuation module 224.

The actuation module 224 receives the predicted and immediate torque requests from the reserves/loads module 220. The actuation module 224 determines how the predicted and immediate torque requests will be achieved. The actuation module 224 may be engine type specific. For example, the actuation module 224 may be implemented differently or use different control schemes for spark-ignition engines versus compression-ignition engines.

In various implementations, the actuation module 224 may define a boundary between modules that are common across all engine types and modules that are engine type specific. For example, engine types may include spark-ignition and compression-ignition. Modules prior to the actuation module 224, such as the propulsion torque arbitration module 206, may be common across engine types, while the actuation module 224 and subsequent modules may be engine type specific.

For example, in a spark-ignition engine, the actuation module 224 may vary the opening of the throttle valve 112 as a slow engine actuator that allows for a wide range of torque control. The actuation module 224 may disable cylinders using the cylinder actuator module 120, which also provides for a wide range of torque control, but may also be slow and may involve drivability and emissions concerns. The actuation module 224 may use spark timing as a fast engine actuator. However, spark timing may not provide as much range of torque control. In addition, the amount of torque control possible with changes in spark timing (referred to as spark reserve capacity) may vary as one or more airflow conditions change.

In various implementations, the actuation module 224 may generate an air torque request based on the predicted torque request. The air torque request may be equal to the predicted torque request, thereby controlling engine airflow actuators so that the adjusted predicted torque request can be rapidly achieved by adjusting one or more actuator values associated with fast engine actuators.

An air control module 228 may determine desired actuator values for the engine airflow actuators based on the air torque request. For example, the air control module 228 may determine a desired manifold absolute pressure (MAP), a desired throttle area, and/or a desired air-per-cylinder (APC). The desired MAP may be used to determine desired boost, and the desired APC may be used to determine desired cam phaser positions. In various implementations, the air control module 228 may also determine a desired opening of the EGR valve 170 and other engine airflow parameters.

The actuation module 224 may also generate a spark torque request, a cylinder shut-off torque request, and a fuel mass torque request. For example only, the actuation module 224 may generate the spark torque request, the cylinder shut-off torque request, and/or the fuel mass torque request based on the immediate torque request.

The actuation module 224 may generate one or more of these requests based on the requestor. As an example, the actuation module 224 may generate one of these torque requests based on the requestor when a fuel cutoff control module 225 generates an immediate torque request for disabling the provision of fuel to the engine 16. The fuel cutoff control module 225 is discussed further below.

The spark torque request may be used by a spark control module 232 to determine how much to retard the spark timing (which reduces the engine output torque) from a calibrated spark advance. The cylinder shut-off torque request may be used by a cylinder control module 236 to determine how many cylinders to deactivate. The cylinder control module 236 may instruct the cylinder actuator module 120 to deactivate one or more cylinders of the engine 16. In various implementations, a predefined group of cylinders may be deactivated jointly.

The cylinder control module 236 may also instruct a fuel control module 240 to stop providing fuel for deactivated cylinders and may instruct the spark control module 232 to stop providing spark for deactivated cylinders. In various implementations, the spark control module 232 only stops providing spark for a cylinder once any fuel/air mixture already present in the cylinder has been combusted.

In various implementations, the cylinder actuator module 120 may include a hydraulic system that selectively decouples intake and/or exhaust valves from the corresponding camshafts for one or more cylinders in order to deactivate those cylinders. For example only, valves for half of the cylinders are either hydraulically coupled or decoupled as a group by the cylinder actuator module 120. In various implementations, cylinders may be deactivated simply by halting provision of fuel to those cylinders, without stopping the opening and closing of the intake and exhaust valves. In such implementations, the cylinder actuator module 120 may be omitted.

The fuel control module 240 may vary the amount of fuel provided to each cylinder based on the fuel mass torque request from the actuation module 224. During normal operation of a spark-ignition engine, the fuel control module 240 may attempt to maintain a stoichiometric air/fuel ratio. The fuel control module 240 may therefore determine a fuel mass that will yield stoichiometric combustion when combined with the current APC. The fuel control module 240 may instruct the fuel actuator module 124 to inject this fuel mass for each activated cylinder.

Based on the fuel mass torque request, the fuel control module 240 may adjust the air/fuel ratio with respect to stoichiometry to increase or decrease engine output torque. The fuel control module 240 may then determine a fuel mass for each cylinder that achieves the desired air/fuel ratio. In diesel systems, fuel mass may be the primary actuator for controlling engine output torque. During fuel cutoff, the actuation module 224 may generate the fuel mass torque request such that the fuel control module 240 disables the provision of fuel to the engine 16.

A torque estimation module 244 may estimate torque output of the engine 16. This estimated torque may be used by the air control module 228 to perform closed-loop control of the engine airflow parameters, such as the throttle area, the MAF, the MAP, the APC, and the phaser positions. For example only, a torque may be determined as a function of: mass of air-per-cylinder (APC); spark advance (S); intake cam phaser position (I); exhaust cam phaser position (E); air/fuel ratio (AF); oil temperature (OT); and number of activated cylinders (#). Additional variables may also be accounted for, such as the degree of opening of an exhaust gas recirculation (EGR) valve.

This relationship may be modeled by an equation and/or may be stored as a lookup table. The torque estimation module 244 may determine the APC based on the MAF and the RPM, thereby allowing closed-loop control of the engine airflow parameters control based on current engine airflow conditions. The intake and exhaust cam phaser positions used may be based on actual positions, as the phasers may be traveling toward desired positions.

The torque estimation module 244 may use the actual spark advance to estimate the engine output torque. When a calibrated spark advance value is used to estimate the engine output torque, the estimated torque may be called an estimated air torque, or simply air torque. The air torque is an estimate of how much torque the engine 16 could generate with the current airflow conditions if spark retard was removed (i.e., spark timing was set to the calibrated spark advance value) and all cylinders were fueled.

The air control module 228 may output a desired area signal to the throttle actuator module 116. The throttle actuator module 116 then regulates the throttle valve 112 to produce the desired throttle area. The air control module 228 may generate the desired area signal based on an inverse torque model and the air torque request. The air control module 228 may use the estimated air torque and/or the MAF signal in order to perform closed-loop control of the engine airflow actuators. For example, the desired area signal may be controlled to minimize a difference between the estimated air torque and the air torque request.

The air control module 228 may output a desired MAP signal to a boost scheduling module 248. The boost scheduling module 248 may use the desired MAP signal to control the boost actuator module 164. The boost actuator module 164 then controls one or more turbochargers (e.g., the turbocharger including the turbine 160-1 and the compressor 160-2) and/or superchargers. The desired MAP may also be used by the throttle actuator module 116 in controlling the throttle valve 112.

The air control module 228 may also output a desired air-per-cylinder (APC) signal to a phaser scheduling module 252. Based on the desired APC signal and the RPM signal, the phaser scheduling module 252 may control positions of the intake and/or exhaust cam phasers 148 and 150 using the phaser actuator module 158.

Referring back to the spark control module 232; calibrated spark advance values may vary based on various engine operating conditions. For example only, a torque relationship may be inverted to solve for desired spark advance. For a given torque request ($T_{des}$), the desired spark advance ($S_{des}$) may be determined as a function of the parameters $T_{des}$, APC, I, E, AF, OT and #. This relationship may be embodied as an equation and/or as a lookup table. The air/fuel ratio (AF) may be the actual air/fuel ratio, as reported by the fuel control module 240.

When the spark advance is set to the calibrated spark advance, the resulting torque may be as close to a mean best torque (MBT) as possible. MBT refers to the maximum engine output torque that is achievable for a given engine airflow conditions as spark advance is increased, while using fuel having an octane rating greater than a predetermined octane rating and using stoichiometric fueling. The spark advance at which the MBT occurs is referred to as MBT spark timing. The calibrated spark advance may differ slightly from MBT spark timing because of, for example, fuel quality (such as when lower octane fuel is used) and environmental factors. The engine output torque produced using the calibrated spark advance may therefore be less than the MBT.

The fuel cutoff control module 225 selectively generates propulsion torque requests for fuel cutoff (FCO) events. For example only, the fuel cutoff control module 225 may generate propulsion torque requests to initiate and to control performance of clutch fuel cutoff (CFCO) events and deceleration fuel cutoff (DFCO) events. The fuel cutoff control module 225 may also generate propulsion torque requests for other types of FCO events.

The fuel cutoff control module 225 may generate a FCO predicted torque request and a FCO immediate torque request. When received, the propulsion torque arbitration module 206 may select the FCO torque requests from the fuel cutoff control module 225 as winning the arbitration. In this manner, the engine actuators are controlled based on the FCO torque requests during FCO events.

In some hybrid vehicles, the fuel cutoff control module 225 may receive a hybrid immediate torque request from the hybrid control module 196. The fuel cutoff control module 225 may generate the FCO immediate torque request based on the hybrid immediate torque request. In other hybrid vehicles, the hybrid control module 196 may provide the hybrid immediate torque request directly to the propulsion torque arbitration module 206. In such implementations, the propulsion torque arbitration module 206 may select the predicted torque request from the fuel cutoff control module 225 and the hybrid immediate torque request from the hybrid control module 196 as winning the arbitration. The engine actuators are then controlled based on these torque requests.

Figure 3:
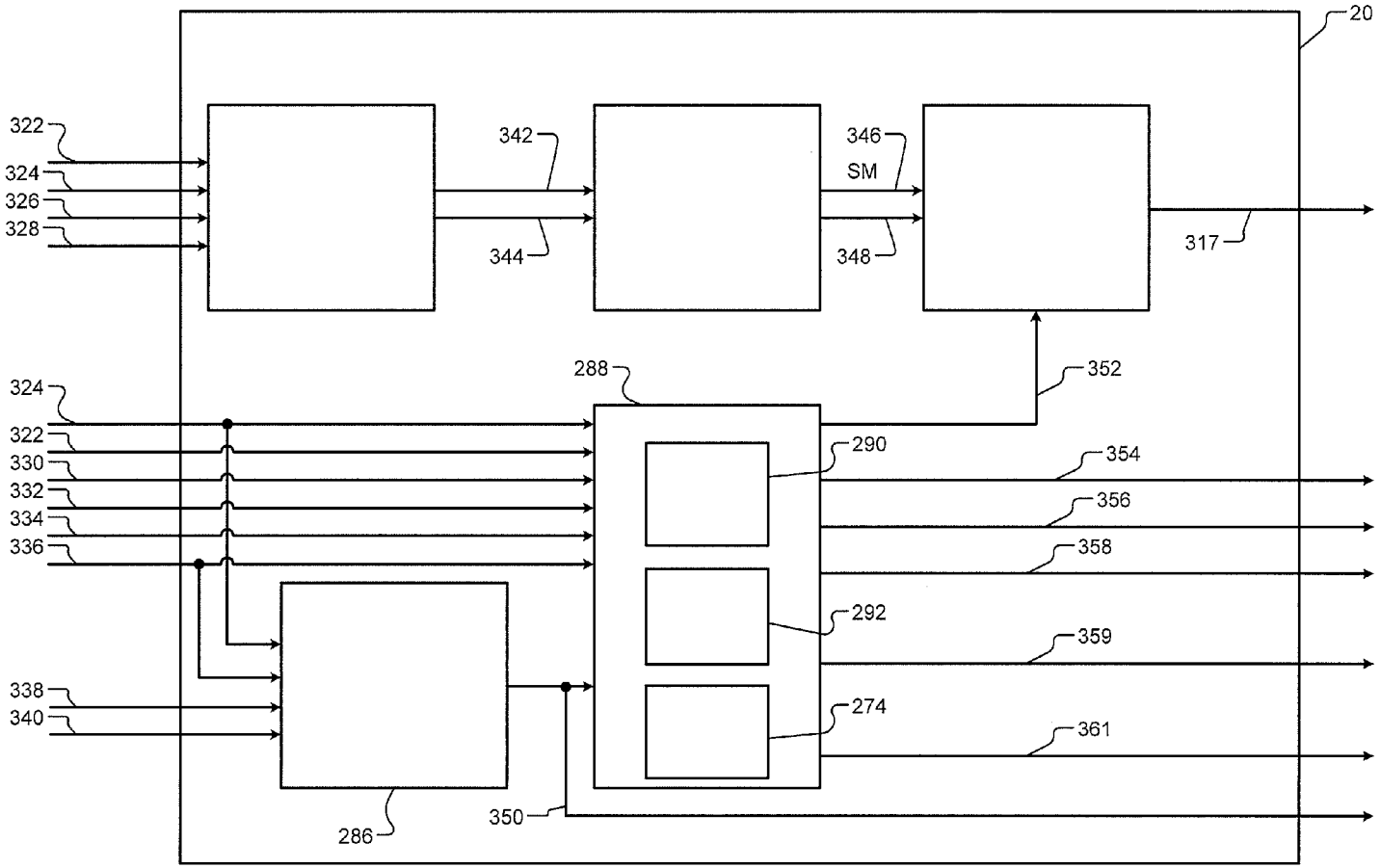
FIG. 3. Is a functional block diagram of the GPF module in accordance with the principles of the present disclosure.

An engine capacities module 274, shown in FIG. 3, may determine one or more torque capacities of the engine 16. For example only, the engine capacities module 274 may determine a maximum off torque capacity and a minimum off torque capacity. The engine capacities module 274 may also determine one or more other engine torque capacities.

The maximum off torque capacity may correspond to a maximum engine output torque achievable with the provision of fuel disabled and the engine airflow actuators adjusted to minimize pumping losses during DFCO. In other words, controlling the engine airflow actuators based on the maximum off torque capacity may achieve a maximum reduction in pumping loss during DFCO.

The minimum off torque capacity may correspond to a minimum engine output torque achievable with the provision of fuel disabled and the engine actuators adjusted to maximize the pumping losses during DFCO. In other words, controlling the engine airflow actuators based on the minimum off torque capacity may provide zero reduction in the pumping losses sustained during DFCO. In some implementations, the minimum off torque capacity and the maximum off torque capacity may be provided to the hybrid control module 196.

The engine capacities module 274 may determine the maximum off torque capacity and the minimum off torque capacity based on the RPM, rubbing friction, and accessory loads applying a braking (i.e., negative) torque to the engine 16. The rubbing friction may be determined based on the oil temperature. The accessory loads may be imposed by, for example, the power steering pump, the air-conditioning (A/C) compressor, and/or other suitable loads.

The minimum off torque capacity may be determined further based on a minimum APC for combustion, and the maximum off torque capacity may be determined further based on a desired MAP or a desired APC. The fuel cutoff control module 225 may provide the desired MAP and/or the desired APC during DFCO. The fuel cutoff control module 225 may determine the desired MAP and the desired APC to achieve a pumping loss reduction during DFCO. In other words, the fuel cutoff control module 225 may determine the desired MAP and the desired APC to achieve a DFCO pumping loss reduction (DPLR).

The fuel cutoff control module 225 may provide a DPLR signal to the phaser scheduling module 252 when DPLR is to be performed. During DPLR, the phaser scheduling module 252 may control valve timing of the intake and exhaust valves 122 and 130 to minimize valve opening overlap. Valve opening overlap may describe a period during which both the intake valve 122 and the exhaust valve 130 are open. Intake and exhaust cam phaser angles to minimize valve opening overlap, and thereby minimize pumping losses, may be predetermined and may be selected based on the operating conditions. When the DPLR signal is not received, the phaser scheduling module 252 may adjust the timing of the intake and exhaust valves 122 and 130 based on the air torque request. For example only, during DFCO, the phaser scheduling module may eliminate valve opening overlap when the DPLR signal is not received.

GPF Regeneration

The GPF module generates a regeneration signal REGEN, a torque reserve request signal TR REQ, a equivalence ratio request signal EQR REQ, a torque capacity request signal TC REQ, a mission profile (or mode) signal MP, a double pulse fueling (DPF) signal, and a camshaft phaser signal CAM PHAS. These signals are provided to modules of the engine control module 17, as shown in FIG. 2. The regeneration signal REGEN indicates whether to regenerate the GPF 22 and is provided to the modules 210, 220, 224, 228, 232, 240, 244, 252. As an example, if the regenerate signal REGEN is HIGH or '1', the GPF 22 is regenerated. If the regenerate signal REGEN is LOW or '0', the GPF 22 is not regenerated.

The torque reserve request signal TR REQ indicates a requested torque reserve and is provided to the reserves/loads module 220. The GPF module 20 may request a torque reserve to increase an amount of heat in the GPF module 20. By providing the torque reserve, spark timing may be retarded and air flow to the GPF may be increased. The reserves/loads module 220 may receive multiple torque reserve requests from the GPF module 20 and other modules of the ECM 17 and/or external to the ECM 17. The reserves/loads module 220 may provide the highest torque reserve requested.

The equivalence ratio request signal EQR REQ requests an equivalence ratio. Lean of stoichiometric AFR is required during GPF regeneration to provide exhaust $O_2$. An equivalence ratio may be determined as (i) a ratio of a current air/fuel ratio (AFR) to a stoichiometric AFR, and/or (ii) a ratio of a stoichiometric AFR to an equivalence ratio commanded. The equivalence ratio may be determined via a table providing a relationship between engine speed and an amount of air-per-cylinder. The equivalence ratio request signal EQR REQ is provided to the torque estimation module 244 and fuel control module 240. The torque estimation module 244 generates the estimated air torque signal based on the regeneration signal REGEN and the equivalence ratio request signal EQR REQ. The fuel control module 240 adjust the fueling rate based on the EQR REQ.

The torque capacity request signal TC REQ indicates a torque capacity requested by the GPF module 20. The mission profile (or mode) signal MP indicates an operating mode and is provided to the RPM trajectory module 212. The mission profile signal MP may be determined based on engine speed, engine load (or an amount of air-per-cylinder), and/or vehicle speed. These parameters may be compared to predetermined thresholds to determine whether the engine is operating idle mode, a light load mode, or a high load mode. The desired RPM is modified in the RPM trajectory module 212 when the mission profile MP signal indicates idle mode and low vehicle speed and when REGEN signal is true or (HIGH). RPM control module 210 generates the corresponding predicted and immediate torque signals PredictedTorque$_{RPM}$, ImmediateTorque$_{RPM}$.

The double pulse fueling signal DPF indicates whether to inject two pulses or multiple pulses of fuel per combustion cycle per cylinder. The double pulse fueling signal DPF is provided to the fuel control module 240, which generates the fuel rate signal based on the regeneration signal REGEN, the equivalence ratio request signal EQR REQ, the DPF signal, and/or the fuel torque request from the actuation module 224.

During regeneration of the GPF 22 and while a torque reserve is requested to retard spark timing in order to increase temperature within the GPF, double or multiple pulse fueling may be requested to aid in stabilizing engine combustion. The camshaft phaser signal CAM PHAS may also be generated to aid in stabilizing engine combustion during regeneration of the GPF 22 and while the torque reserve is requested.

During regeneration of the GPF 22, the GPF module, via the mission profile signal MP, requests an increase an idle speed of the engine 16 to increase a temperature of the GPF 22. The engine may not generate enough heat at slower engine speeds associated with idle to regenerate the GPF 22. When calibrated to allow regeneration of a filter during an idle state, more air flow is requested and indicated to the RPM control module 210. While the engine is operating in an idle state, the requested idle speed increase enables the GPF 22 to achieve an appropriate temperature for regeneration. The mission profile signal MP is provided to the RPM trajectory module. The RPM control module 210 generates the predicted and immediate torque signals PredictedTorque$_{RPM}$, ImmediateTorque$_{RPM}$ based on the desired RPM signal.

Figure 4:
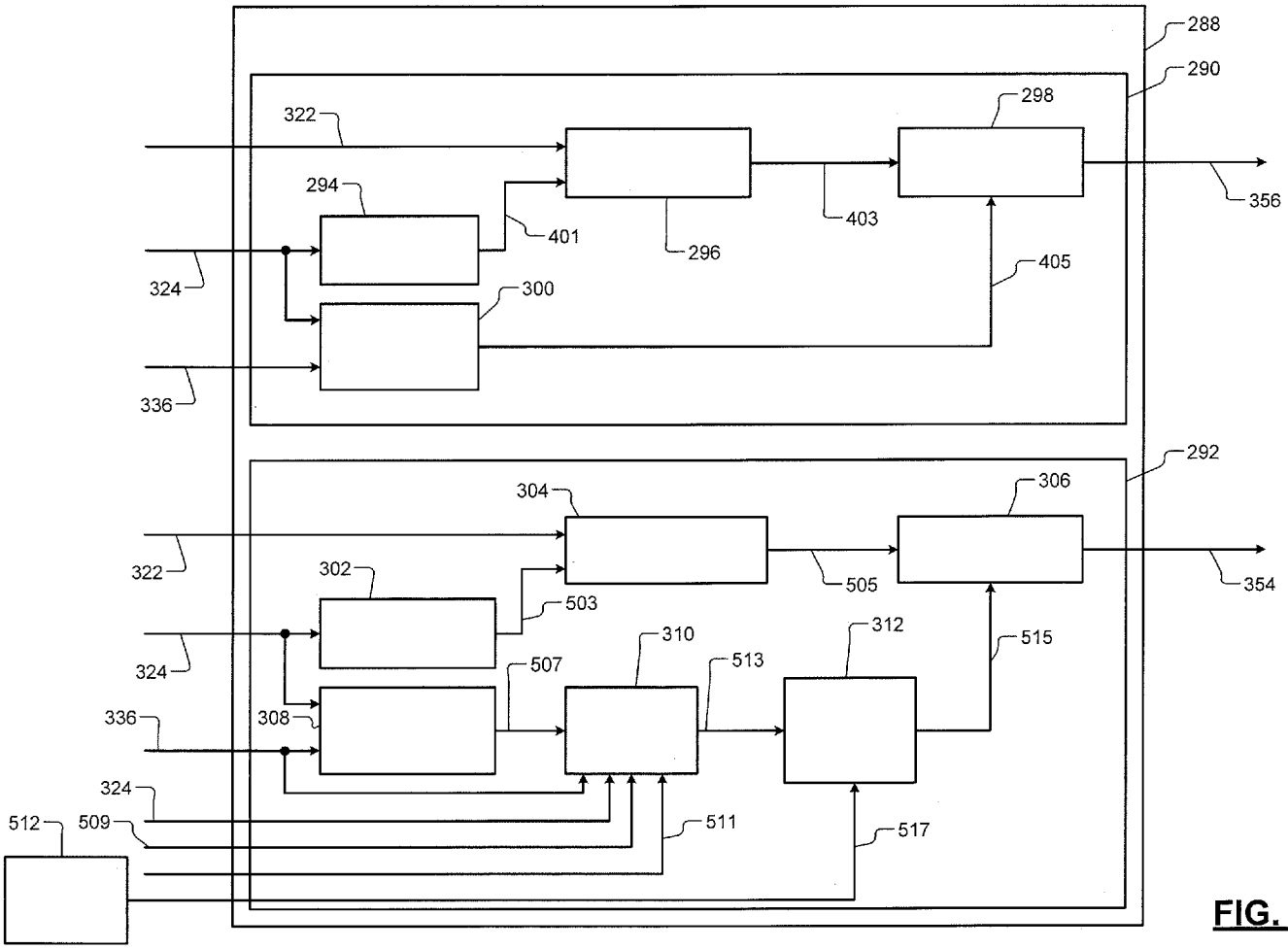
FIG. 4 is a functional block diagram of a coordinator module of the GPF module in accordance with the principles of the present disclosure.

FIG. 3 shows the GPF module 20. The GPF module 20 includes a GPF status module 280, a soot module 282, a regeneration module 284, a mode module 286 and a coordinator module 288. FIG. 4 shows the coordinator module 288. The coordinator module 288 includes a torque reserve output module 290 and an equivalence ratio output module 292. The torque reserve output module 290 includes a first threshold module 294, an equivalence ratio enabling module 296, an equivalence ratio forwarding module 298 and an equivalence ratio determining module 300. The equivalence ratio output module 292 includes a second threshold module 302, a torque reserve enabling module 304, a torque reserve forwarding module 306, a spark timing module 308, a torque determining module 310 and a torque reserve determining module 312. The modules of FIG. 3 are described with respect to the method of FIG. 5. The modules of FIG. 4 are described with respect to the methods of FIGS. 6-7.

Figure 5:
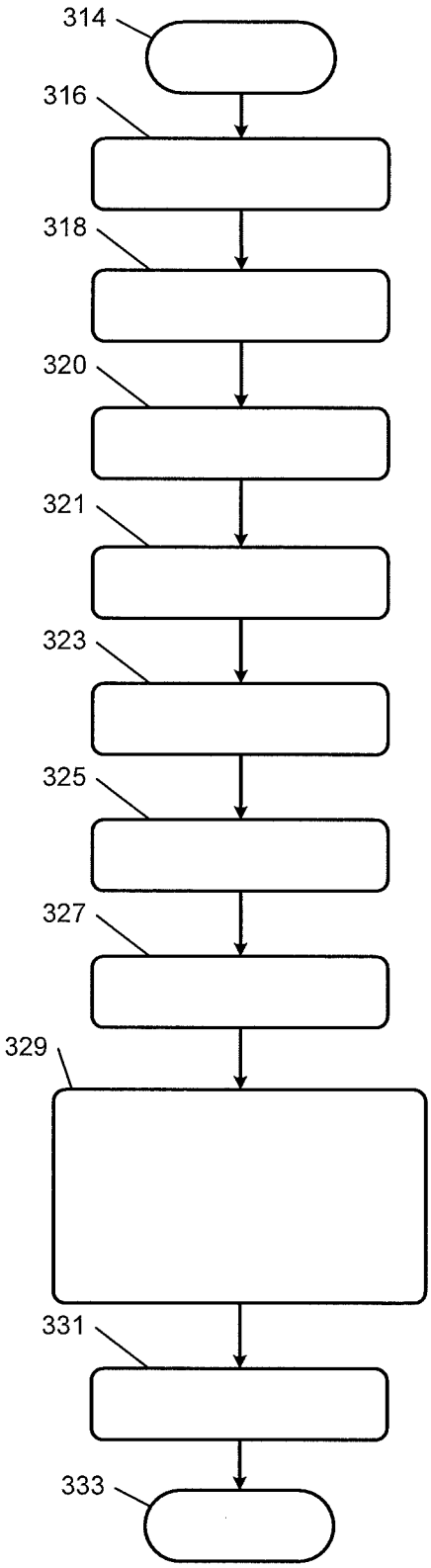
FIG. 5 illustrates a regeneration method in accordance with the principles of the present disclosure.
Figure 6:
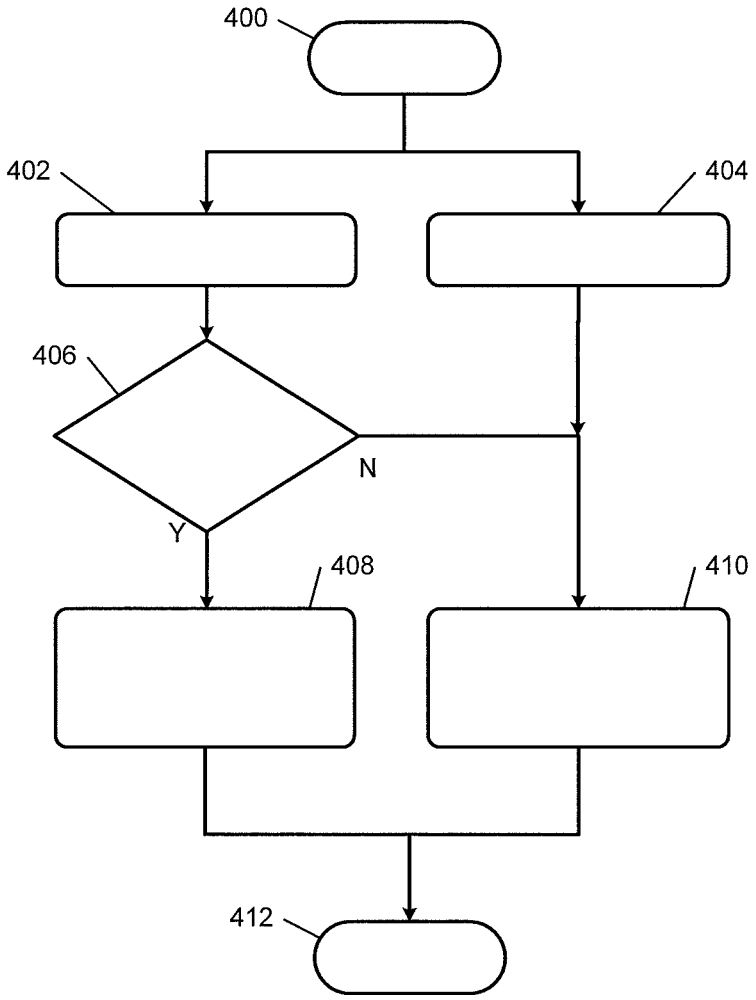
FIG. 6 illustrates an equivalence ratio method in accordance with the principles of the present disclosure.
Figure 7:
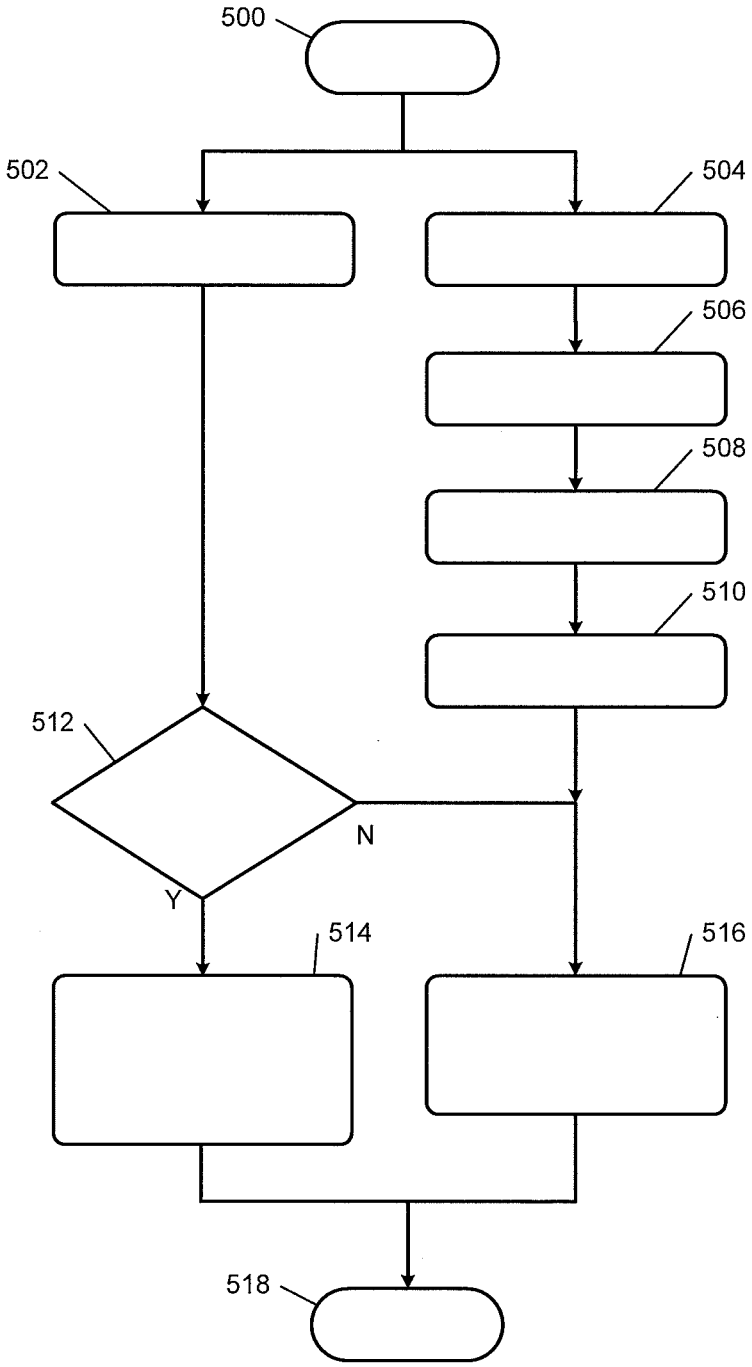
FIG. 7 illustrates a torque reserve method in accordance with the principles of the present disclosure.

The engine systems disclosed herein may be operated using numerous methods, example methods are illustrated in FIGS. 5-7. The methods of FIGS. 6-7 may be performed while performing the method of FIG. 5. The method of FIG. 7 may be performed while performing the method of FIG. 6. In FIG. 5, a regeneration method is shown. Although the following tasks are primarily described with respect to the implementations of FIG. 5, the tasks may be easily modified to apply to other implementations of the present disclosure. The tasks may be iteratively performed.

The method may begin at 314. At 316, parameters are generated and/or measured, as described above. The parameters may include a temperature $T_{GPF}$ (322) of the GPF 22, a speed RPM (324) of the engine 16, a barometric pressure BARO (326), a difference in pressure dP (328) (e.g., P2-P1) across the GPF 22, a temperature MAT (330) of the catalyst 136, a turbo protection signal TURBO (332), a temperature $T_{ENG}$ (334) of the engine 16, an amount of air-per-cylinder (APC) signal (336), a vehicle speed signal VS (338), and an idle state signal IDLE (340). The turbo protection signal may be set LO if, for example, operating conditions of the turbo are appropriate for regeneration of the GPF 22. If the operating conditions are inappropriate for regeneration, then the turbo protection signal may be set HI. The idle status signal IDLE may indicate whether the engine 16 is operating in an idle state (i.e. running at an idle speed).

At 318, the GPF status module 280 determines an ideal soot capacity (ISC) (342). A GPF may have an initial internal volume when new and be capable of holding a predetermined maximum amount (or mass) of soot. As the GPF is used over time there can be an amount of oil ash that builds up in the GPF. The oil ash may not be regenerated (or burned) out of the GPF. As a result, the internal volume and/or maximum amount (or mass) of soot that the GPF can hold decreases over time due to the build-up of oil ash. The ISR indicates the available internal volume after accounting for the ash buildup at a current time. The tables may be based on: models of the GPF 22; age of the GPF 22, hours of use of the GPF 22, mileage of the corresponding vehicle during which the GPF 22 was used, etc. The tables may be stored in memory of the ECM 17.

At 320, the GPF status module determines a flow resistance FR (344) based on the temperature $T_{GPF}$, the speed RPM, the barometric pressure BARO, and the differential pressure dP. Task 320 may be performed while performing task 318. The flow resistance FR may be equal to the differential pressure dP (or pressure drop across the GPF 22) divided by a current volumetric flow rate through the GPF 22. The volumetric flow rate of exhaust may be determined based on the exhaust mass flow rate and temperature $T_{GPF}$.

At 321, the soot module 282 determines a current amount of soot mass SM (346) in the GPF 22 based on FR, a volume flow rate of exhaust passing through the GPF 22, the temperature of the GPF 22 (the temperature $T_{GPF}$ and/or an inlet temperature of the GPF 22), and the current amount of oil ash present in the GPF 22. Predetermined tables and/or a model of the GPF 22 relating these parameters may be used to determine the current amount of soot mass SM. The tables and/or model may be stored in memory of the ECM 17. The FR, volume flow rate of exhaust passing through the GPF 22, temperature of the GPF 22, and the current amount of oil ash present in the GPF 22 may be used to determine intermediate values, which may then be used to estimate the current amount of soot mass SM.

At 323, the soot module 282 determines a soot percentage Soot % (348). Task 321 may be performed while performing task 320. The soot percentage Soot % may be equal to the current amount of soot mass SM divided by the ideal soot capacity ISC.

At 325, the mode module 286 determines an operating mode indicated via the mission profile signal MP (350). The mode module 286 may determine the operating mode based on the engine speed RPM, the air-per-cylinder APC, the vehicle speed VS, and the idle speed signal IDLE. For example, when the engine speed signal RPM and/or the idle speed signal IDLE indicates that the engine is operating at an idle speed, the mission profile signal MP may indicate operating in the idle mode. To aid in regeneration of soot in the GPF 22, the idle speed may be increased during regeneration of the GPF 22 to increase an amount of heat out of the engine. Excess oxygen may exist in the GPF 22 to oxidize the soot trapped in the GPF 22. The increased heat output increases oxidation of the soot. This may include adjusting and/or using a different idle speed profile during regeneration. If the temperature $T_{GPF}$ of the GPF 22 is less than a predetermined temperature (e.g., 450° C.), then the idle speed may be increased from a first speed to a second speed to increase temperature of the GPF 22. This increase in idle speed may be requested via the mission profile signal MP, which is provided to the RPM control module 210. The RPM control module 210 may then generate the immediate and predicted torque signals immediate $torque_{RPM}$, predicted $torque_{RPM}$ to increase the idle speed. In addition a torque reserve and lean of stoichiometry EQR may be requested.

If the engine speed RPM, the air-per-cylinder APC, the vehicle speed VS, and/or the idle speed signal IDLE indicate that the engine is not operating at idle and corresponding values are within predetermined ranges indicating a low load condition, then the mission profile signal MP indicates operation in the low load mode. If the engine speed RPM, the air-per-cylinder APC, the vehicle speed VS, and/or the idle speed signal IDLE indicate that the engine is not operating at idle and corresponding values are within predetermined ranges indicating a high load condition, then the mission profile signal MP indicates operation in the high load mode. During low load and high load mode, the RPM request (or engine speed) does not increase. The speed control module 210 does not change operating functions during GPF regeneration (or regeneration mode). The fuel control module 240 may request DPF during the low load mode.

At 327, the coordinator module generates a regeneration enable signal ENABLE (352) indicating whether to enable regeneration of the GPF 22. The regeneration enable signal ENABLE may be set HIGH when certain predetermined operating conditions exist. The predetermined operating conditions refer to the engine speed RPM, the temperatures $T_{GPF}$, $T_{CAT}$, $T_{ENG}$, the turbo protection signal TURBO, and the air-per-cylinder APC being within respective predetermined ranges and/or in predetermined states.

At 329, the coordinator module 288 generates each of a torque request TR REQ (354), a equivalence ratio request EQR REQ (356), and a torque capacity request TC REQ (358) based on various parameters. The parameters may include, as shown, the engine speed RPM, the temperatures $T_{GPF}$, $T_{CAT}$, $T_{ENG}$, the turbo protection signal TURBO, and the amount of air-per-cylinder APC. The torque request signal TR REQ may be determined as described below at tasks 502-514. During regeneration of the GPF 22, the torque request signal TR REQ is generated to increase air flow to the GPF 22 and retard spark timing of the engine 16. The air flow to the GPF 22 may be increased by increasing air flow out of the engine 16 (or further opening a throttle valve). This is done to maintain a current output torque of the engine 16. Thus, the torque output of the engine 16 during regeneration of the GPF 22 may be the same as torque output of the engine 16 during regeneration of the GPF 22.

During regeneration, the spark is retarded to bring the GPF 22 up to a predetermined temperature for soot oxidation to occur. The air flow out of the engine 16 is increased to maintain a same level of torque out of the engine 16. The camshaft phaser signal CAM PHAS (359) and double pulse fueling signal DPF (361) may be generated to stabilize combustion events within the engine 16, as described above. The camshaft phaser signal CAM PHAS and double pulse fueling signal DPF may be generated based on the regeneration signal REGEN and/or the torque reserve request signal TR REQ. For example, camshaft phaser timing may be adjusted and/or multi-pulse mode may be performed when (i) the regeneration signal REGEN indicates the GPF 22 is being regenerated, and/or (ii) the torque reserve request signal TR REQ requests a torque reserve for increased air flow and retarded spark timing.

The equivalence ratio request EQR REQ may be determined as described above and/or below with respect to task 404. The engine capacities module 274 may generate the torque capacity request TC REQ as described above. Task 329 may be performed while performing task 327. Tasks 325, 327, and 329 may be performed while performing tasks 318, 320, 321, 323.

At 331, the regeneration module 284 generates the regeneration signal REGEN (317) based on the current amount of soot mass SM, the soot percentage Soot %, and the regeneration enable signal ENABLE. The regeneration signal REGEN indicates whether the GPF module and/or the ECM 17 is regenerating the GPF 22. The regeneration signal REGEN may be HIGH if, for example, the soot percentage Soot % is greater than a predetermined soot percentage threshold. The regeneration signal REGEN may be LOW if, for example, the soot percentage Soot % is less than or equal to the predetermined soot percentage threshold. The regeneration module 284 compares the soot percentage Soot % to the predetermined soot percentage threshold to determine whether to regenerate the GPF 22. The regeneration signal REGEN may be generated and/or indicated regeneration of the GPF 22 if the regeneration enable signal ENABLE is HIGH. The method may end at 333.

FIG. 6 shows an equivalence ratio method. The following tasks may be iteratively performed. The method may begin at 400. At 402, the first threshold module 294 determines a first threshold THRS1 (401) based on the engine speed RPM. As an example, the first threshold may be 450° C. or other predetermined temperature. The first threshold may be different than the predetermined temperature described above at 312.

At 404, the equivalence ratio determining module 300 determines an equivalence ratio EQR (405), as described above. The equivalence ratio may be determined based on the engine speed RPM and the amount of air-per-cylinder APC. The equivalence ratio request EQR REQ may be equal to a stoichiometric air fuel ratio divided by an air/fuel ratio commanded. The equivalence ratio request EQR REQ may be determined based on a profile (or map) relating the equivalence ratio request EQR REQ to the engine speed RPM and the amount of air-per-cylinder APC. The equivalence ratio may be less than 1 to provide lean engine operation during regeneration of the GPF 22. Running lean may reduce temperature of an exhaust gas and thus reduces temperature of the GPF 22.

At 406, the equivalence ratio enabling module 296 determines whether to enable generation of the equivalence ratio request signal EQR REQ. As an example, the equivalence ratio enabling module 296 compares the temperature $T_{GPF}$ to the first threshold. If the temperature $T_{GPF}$ is less than the first threshold, then task 408 is performed. At 408, the equivalence ratio enable signal EQRENABLE (403) is set LOW. The equivalence ratio enable signal EQRENABLE is set LOW to maintain fueling of the engine 16 at a stoichiometric level. By disabling forwarding of the equivalence ratio request signal EQR REQ, the engine 16 may be operated at the stoichiometric air fuel ratio for a period of time to increase temperature of the GPF 22.

If the temperature $T_{GPF}$ is greater than or equal to the first threshold, then task 410 is performed. At 410, the equivalence ratio enable signal EQRENABLE is set HIGH. The equivalence ratio enable signal EQRENABLE is set HIGH to allow the equivalence ratio forwarding module 298 to forward the equivalence ratio request signal EQR REQ to the fuel control module 240. The method may end at 412.

FIG. 7 shows a torque reserve method. The following tasks may be iteratively performed. The method may begin at 500. At 502, the second threshold module 302 determines a second threshold (503) based the engine speed RPM. The second threshold may the same as or different than the first threshold described above at 402. As an example, the first threshold may be 500° C. and the second threshold may be 550° C.

At 504, the spark timing module 308 generates a spark angle signal SA (507) based on the engine speed RPM and the amount of air-per-cylinder APC. The spark angle may be retarded during regeneration of the GPF 22. The spark angle during regeneration may be retarded as compared to a spark angle prior to or subsequent to regeneration. The spark angle may be determined based on: ambient pressure; the temperature $T_{ENG}$; whether the engine 16 is in an idle state; engine load; the engine speed RPM; a current operating spark angle; and/or other spark related parameters. Multiple transformation mappings may be used with a current spark angle operating point and the spark related parameters to determine the next spark angle.

At 506, the torque determining module determines an amount of torque (513) based on the spark angle signal SA, the engine speed RPM, the amount of air-per-cylinder APC, an intake camshaft phaser position ICP (509), and an exhaust camshaft phaser position (511). The amount of torque may be determined based on tables and/or profiles relating these parameters. The amount of torque may refer to an output torque of the engine 16. The amount of torque may refer to an amount of torque that is produced by the engine 16 with the current spark angle timing and air-per-cylinder.

At 508, an unmanaged torque module 512, which may be included in the ECM 17, determines an unmanaged toque $T_{un}$ (517). The unmanaged torque $T_{un}$ refers to torque provided with spark equal to minimum spark for best torque output value $S_{MBT}$.

At 510, the torque reserve determining module 312 determines a torque reserve TR (515). The torque reserve TR may be set equal a difference between (i) the unmanaged torque $T_{un}$, and (ii) an immediate torque or the amount of torque determined at 506. The torque reserve may be based on a current output torque of the engine and the torque value determined at 506.

As an example, ECM 17 may determine delta spark or ΔS, which refers to a difference between a minimum spark $S_{Min}$ and a spark base $S_b$. Minimum spark $S_{un}$ may be a predetermined value and refers to a minimum spark value or minimum spark advance value when operating an engine in a multi-pulse mode, such as when operating in a double-pulse mode. Spark base $S_B$ refers to spark advance that provides a minimum amount of hydrocarbons when operating in a multi-pulse mode. ΔS is determined based on the amount of air-per-cylinder APC and the engine speed RPM. The minimum spark $S_{Min}$ may be determined based on the amount of air-per-cylinder APC, the engine speed RPM, the intake camshaft phaser position ICP, and the exhaust camshaft phaser position ECP. The minimum spark $S_{Min}$ may be determined using stored tabular data. The spark base $S_b$ may be determined by subtracting ΔS from the minimum spark $S_{Min}$. The spark base $S_b$ may be used to generate a spark command signal $S_{Final}$, as shown by expression 1, where $S_p$ is proportional spark. The spark command signal $S_{Final}$ may refer to the spark control signal that is used for timing of spark within the cylinders of the engine 16. Expression 2 provides idle speed spark limitations for a sum of the spark base $S_b$ and the proportional spark $S_b$.

$$S_{Final}=S_b+S_p \tag{1}$$

$$S_{Min}<S_b+S_p<S_{Max} \tag{2}$$

A torque base $T_b$ may be determined based on the spark base $S_b$, the engine speed RPM, the amount of air-per-cylinder APC, the intake camshaft phaser position ICP, and the exhaust camshaft phaser position ECP. The torque base $T_b$ may be determined as provided by expression 3.

$$T_b=f(\text{RPM},\text{ICP},\text{ECP},S_b,\text{APC}) \tag{3}$$

The torque base $T_b$ may be subtracted from the unmanaged torque $T_{un}$ to generate the torque reserve TR. The torque reserve TR may be determined as provided by expression 7.

$$\text{TR}=T_{UN}-T_B \tag{7}$$

The torque reserve TR may be created by setting slower engine actuators to produce a predicted torque, while setting faster engine actuators to produce an immediate torque that is less than the predicted torque. For example, a throttle valve can be opened, thereby increasing air flow and preparing to produce the predicted torque. Meanwhile, the spark advance may be reduced (in other words, spark timing may be retarded), reducing the actual engine torque output to the immediate torque.

The difference between the predicted and immediate torques may be called the torque reserve TR, this is same as the difference between unmanaged torque $T_{UN}$ and immediate torque. When a torque reserve is present, the engine output torque can be quickly increased from the immediate torque to the predicted torque by changing a faster actuator. The predicted torque is thereby achieved without waiting for a change in torque to result from an adjustment of one of the slower actuators.

At 512, the torque reserve enabling module 304 compares the temperature $T_{GPF}$ to the second threshold. If the temperature $T_{GPF}$ is greater than the second threshold, then task 514 is performed. At 514, the torque reserve enable signal TRENABLE is set HIGH. If the temperature $T_{GPF}$ is less than or equal to the second threshold THRS2, then task 516 is performed. At 516, the torque reserve enable signal TRENABLE is set low.

At 514, the torque reserve forwarding module 306 generates the torque reserve request signal TR REQ to indicate the torque reserve TR if the torque reserve enable signal TRENABLE is HIGH. Task 502 may be performed if the torque reserve enable signal TRENABLE is LOW, or the method may end at 516.

The above-described tasks of FIGS. 5-7 are meant to be illustrative examples; the tasks may be performed sequentially, synchronously, simultaneously, continuously, during overlapping time periods or in a different order depending upon the application. Also, any of the tasks may not be performed or skipped depending on the implementation and/or sequence of events.

The above-described methods including triggering an alternate engine operation when an amount of soot accumulated in a GPF exceeds a threshold. This alternate engine operation includes requesting a torque reserve such that spark timing is retarded while an amount of air flow is increased to the GPF. The alternate engine operation is provided while maintaining an amount of torque out of the engine. The air/fuel ratio of the engine is changed to operate lean (EQR<1) and a corresponding toque model is used to compensate to provide a same amount of output torque. As a result the amount of output torque is unchanged during regeneration as prior to regeneration. The regeneration of the GPF maintains low soot levels in the GPF to maintain efficient engine operation and performance. This also increases durability of an engine system.

The above-described methods also include accounting for drops in exhaust and/or GPF temperature due to operating lean. The methods include operating an engine at a stoichiometric air/fuel ratio until a temperature of exhaust gas entering a GPF and/or a temperature of the GPF is greater than a threshold. The engine is then operated with a lean air/fuel ratio to oxidize soot. Closed loop feedback control is provided to assure that the temperature of the GPF remains above the threshold for soot oxidation. Control may cycle between running at stoichiometric air/fuel ratio and lean to maintain the temperature of the GPF above the threshold. Maintaining the temperature of the GPF reduces time needed to regenerate the GPF. By minimizing the time needed to regenerate the GPF, a period of inefficient engine operation with potential drivability and performance compromises is minimized.

The above-described methods also include disabling torque reserve requested during regeneration of a GPF, where the torque reserve was requested to retard spark and maintain a current output toque. This is performed to improve rate of regeneration and engine performance. If a temperature of an exhaust gas being received by the GPF and/or a temperature of the GPF is greater than a threshold, the GPF torque reserve request is disabled. The GPF torque reserve request is enabled when the temperature of the exhaust gas and/or GPF is less than the threshold. This provides feedback control on exhaust enthalpy. This temperature feedback control adapts regeneration of the GPF to ambient conditions and other variations.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. As used herein, the phrase at least one of A, B, and C should be construed to mean a logical (A OR B OR C), using a non-exclusive logical OR, and should not be construed to mean "at least one of A, at least one of B, and at least one of C." It should be understood that one or more steps within a method may be executed in different order (or concurrently) without altering the principles of the present disclosure.

In this application, including the definitions below, the term 'module' or the term 'controller' may be replaced with the term 'circuit.' The term 'module' may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

The term code, as used above, may include software, firmware, and/or microcode, and may refer to programs, routines, functions, classes, data structures, and/or objects. The term shared processor circuit encompasses a single processor circuit that executes some or all code from multiple modules. The term group processor circuit encompasses a processor circuit that, in combination with additional processor circuits, executes some or all code from one or more modules. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules. The term group memory circuit encompasses a memory circuit that, in combination with additional memories, stores some or all code from one or more modules.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium are nonvolatile memory circuits (such as a flash memory circuit, an erasable programmable read-only memory circuit, or a mask read-only memory circuit), volatile memory circuits (such as a static random access memory circuit or a dynamic random access memory circuit), magnetic storage media (such as an analog or digital magnetic tape or a hard disk drive), and optical storage media (such as a CD, a DVD, or a Blu-ray Disc).

The apparatuses and methods described in this application may be partially or fully implemented by a special purpose computer created by configuring a general purpose computer to execute one or more particular functions embodied in computer programs. The functional blocks and flowchart elements described above serve as software specifications, which can be translated into the computer programs by the routine work of a skilled technician or programmer.

The computer programs include processor-executable instructions that are stored on at least one non-transitory, tangible computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language) or XML (extensible markup language), (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C#, Objective C, Haskell, Go, SQL, R, Lisp, Java®, Fortran, Perl, Pascal, Curl, OCaml, Javascript®, HTML5, Ada, ASP (active server pages), PHP, Scala, Eiffel, Smalltalk, Erlang, Ruby, Flash®, Visual Basic®, Lua, and Python®.

None of the elements recited in the claims are intended to be a means-plus-function element within the meaning of 35 U.S.C. §112(f) unless an element is expressly recited using the phrase "means for," or in the case of a method claim using the phrases "operation for" or "step for."

What is claimed is:

1. A system comprising:

a soot module configured to determine a current amount of soot mass in a particulate filter of a gasoline engine, wherein the particulate filter is downstream from the gasoline engine and receives an exhaust gas from the gasoline engine;

a coordinator module configured to generate an enable signal, a torque reserve signal, and a first equivalence ratio, wherein the first equivalence ratio is (i) a ratio of a current air/fuel ratio to a stoichiometric air/fuel ratio, or (ii) a ratio of the stoichiometric air/fuel ratio to a commanded second equivalence ratio, wherein the torque reserve signal indicates at least one of (i) a difference between an immediate torque request and a predicted torque request, and (ii) an amount of torque more than the immediate torque request that the gasoline engine is able to produce within a predetermined period of time;

a regeneration module configured to, based on the current amount of soot mass and the enable signal, generate a regeneration signal to regenerate the particulate filter; and a plurality of actuator modules configured to, based on the regeneration signal, the torque reserve signal and the first equivalence ratio, (i) retard spark of the gasoline engine, and (ii) increase an amount of air flow to the particulate filter, wherein the plurality of actuator modules are configured to maintain a same amount of torque out of the gasoline engine during regeneration of the particulate filter as output from the gasoline engine prior to the regeneration of the particulate filter.

2. The system of claim 1, further comprising a status module configured to generate (i) an ideal soot capacity value, and (ii) a flow resistance value based on (a) a temperature of the particulate filter, (b) a speed of the gasoline engine, and (c) a pressure differential across the particulate filter, wherein the soot module is configured to determine the current amount of soot mass based on the ideal soot capacity value and the flow resistance value.

3. The system of claim 2, wherein:

the status module is configured to generate the flow resistance value base on a barometric pressure; and wherein the soot module is configured to determine the current amount of soot mass based on the barometric pressure.

4. The system of claim 1, wherein:

the soot module is configured to determine a soot percentage based on the current amount of soot; and the regeneration module is configured to generate the regeneration signal based on the soot percentage.

5. The system of claim 4, further comprising a status module configured to generate (i) an ideal soot capacity value, and (ii) a flow resistance value based on (a) a temperature of the particulate filter, (b) a speed of the gasoline engine, and (c) a pressure differential across the particulate filter, wherein:

the soot module is configured to (i) determine the current amount of soot mass based on the ideal soot capacity value and the flow resistance value, and (ii) the soot percentage based on the ideal soot capacity value.

6. The system of claim 1, wherein:

the coordinator module is configured to generate the enable signal, torque reserve signal, and the first equivalence ratio based on a plurality of parameters; and the plurality of parameters include a speed of the gasoline engine, a temperature of the particulate filter, a temperature of a catalyst, a temperature of the gasoline engine, and an amount of air-per-cylinder of the gasoline engine.

7. The system of claim 1, wherein:

the coordinator module is configured to adjust a camshaft phaser position or operate in a multi-fuel injection mode during regeneration of the particulate filter; and the multi-fuel injection mode includes injecting multiple pulses of fuel in a cylinder of the gasoline engine during a combustion cycle of the gasoline engine.

8. A system comprising:

a soot module configured to determine a current amount of soot mass in a particulate filter of a gasoline engine, wherein the particulate filter is downstream from the gasoline engine and receives an exhaust gas from the gasoline engine;

an enabling module configured to compare a temperature of the exhaust gas entering the particulate filter to a predetermined threshold and generate an enable signal based on the comparison;

a coordinator module configured to, based on the comparison, generate a first equivalence ratio that is lean of stoichiometry, wherein the first equivalence ratio is (i) a ratio of a current air/fuel ratio to a stoichiometric air/fuel ratio, or (ii) a ratio of the stoichiometric air/fuel ratio to a commanded second equivalence ratio;

a regeneration module configured to, based on the current amount of soot mass, generate a regeneration signal to regenerate the particulate filter; and a plurality of actuator modules configured to operate the engine at a stoichiometric air/fuel ratio based on whether the first equivalence ratio is generated, and based on the regeneration signal and the first equivalence ratio, increase an amount of air flow to the particulate filter; wherein:

the coordinator module is further configured to generate a second enable signal and a torque reserve signal, wherein the torque reserve signal indicates at least one of (i) a difference between an immediate torque request and a predicted torque request, and (ii) an amount of torque more than the immediate torque request that the gasoline engine is able to produce within a predetermined period of time;

the regeneration module is configured to, based on the current amount of soot mass and the second enable signal, generate the regeneration signal to regenerate the particulate filter; and based on the regeneration signal and the first equivalence ratio, (i) retard spark of the gasoline engine, and (ii) increase the amount of air flow to the particulate filter.

9. The system of claim 8, further comprising a threshold module configured to compare the temperature of the particulate filter to a second predetermined threshold, wherein the coordinator module is configured to generate the torque reserve signal based on whether the temperature of the particulate filter is less than the second predetermined threshold.

10. The system of claim 8, wherein the coordinator module is configured to generate the first equivalence ratio if the temperature of the particulate filter is greater than the predetermined threshold.

11. The system of claim 10, wherein the coordinator module is configured to refrain from generating the first equivalence ratio if the temperature of the particulate filter is less than or equal to the predetermined threshold.

12. The system of claim 8, further comprising:

a spark timing signal configured to determine a spark angle based on a speed of the gasoline engine and an amount of air-per-cylinder of the gasoline engine;

a torque determining module configured to determine an amount of torque based on the spark angle; and a torque reserve module configured to determine a torque reserve based on the amount of torque, wherein the coordinator module is configured to generate a torque reserve signal to indicate the torque reserve, and wherein the plurality of actuator modules are configured to operate the gasoline engine lean based on the torque reserve signal.

13. The system of claim 12, further comprising an unmanaged torque module configured to determine an unmanaged torque value, wherein:

the torque reserve module is configured to determine the torque reserve based on the unmanaged torque.

14. A system comprising:

a soot module configured to determine a current amount of soot mass in a particulate filter of a gasoline engine, wherein the particulate filter is downstream from the gasoline engine and receives an exhaust gas from the gasoline engine;

an enabling module configured to compare a temperature of the exhaust gas entering the particulate filter to a predetermined threshold and generate an enable signal based on the comparison;

a coordinator module configured to, based on the comparison, generate a torque reserve signal based on a temperature of the particulate filter, wherein the coordinator module is configured to generate the torque reserve signal based on whether the temperature of the particulate filter is less than the predetermined threshold, wherein the torque reserve signal indicates at least one of (i) a difference between an immediate torque request and a predicted torque request, and (ii) an amount of torque more than the immediate torque request that the gasoline engine is able to produce within a predetermined period of time;

a regeneration module configured to, based on the current amount of soot mass, generate a regeneration signal to regenerate the particulate filter; and a plurality of actuator modules configured to retard spark of the gasoline engine based on (i) the regeneration signal, and (ii) the torque reserve signal.

15. The system of claim 14, wherein:

the coordinator module configured to generate a second enable signal and an equivalence ratio;

the regeneration module configured to, based on the current amount of soot mass and the second enable signal, generate the regeneration signal to regenerate the particulate filter; and the plurality of actuator modules configured to, based on the equivalence ratio, increase an amount of air flow to the particulate filter.

16. The system of claim 15, further comprising a threshold module configured to compare the temperature of the particulate filter to a second predetermined threshold, wherein the coordinator module is configured to generate the equivalence ratio based on the comparison of the temperature of the particulate filter to the second predetermined threshold.

17. The system of claim 14, wherein the coordinator module is configured to (i) generate the torque reserve signal if the temperature of the particulate filter is less than the predetermined threshold, and (ii) refrain from generating the torque reserve signal if the temperature of the particulate filter is greater than or equal to the predetermined threshold.

18. The system of claim 14, further comprising:

a spark timing signal configured to determine a spark angle based on a speed of the gasoline engine and an amount of air-per-cylinder of the gasoline engine;

a torque determining module configured to determine an amount of torque based on the spark angle; and a torque reserve module configured to determine a torque reserve based on the amount of torque, wherein the coordinator module is configured to generate the torque reserve signal to indicate the torque reserve.

19. The system of claim 18, further comprising an unmanaged torque module configured to determine an unmanaged torque value, wherein:

the torque reserve module is configured to determine the torque reserve based on the unmanaged torque.

* * * * *